United States Patent [19]

Herbert, Jr. et al.

[11] Patent Number: 4,781,799

[45] Date of Patent: Nov. 1, 1988

[54] ELECTROFORMING APPARATUS AND PROCESS

[75] Inventors: William G. Herbert, Jr., Williamson, N.Y.; Toru Nozaki, Minami-ashigara; Akio Onishi, Ebina, both of Japan

[73] Assignees: Xerox Corporation, Stamford, Conn.; Fuji Xerox Co. Ltd., Ebina, Japan

[21] Appl. No.: 939,503

[22] Filed: Dec. 8, 1986

[51] Int. Cl.[4] ..... C25D 1/02

[52] U.S. Cl. ..... 204/9

[58] Field of Search ..... 204/9

[56] References Cited

U.S. PATENT DOCUMENTS

| | | | |
|---|---|---|---|
| 799,634 | 9/1905 | Cowper-Coles | 204/12 |
| 2,613,178 | 10/1952 | Grant | 204/9 |
| 2,879,209 | 3/1959 | Fialkoff | 204/9 |
| 3,022,230 | 2/1962 | Fialkoff | 204/9 |
| 3,512,252 | 5/1970 | Sargent | 204/9 |
| 3,830,710 | 8/1974 | Narozanski et al. | 204/12 |
| 3,844,906 | 10/1974 | Bailey et al. | 204/9 |
| 4,501,646 | 2/1985 | Herbert | 204/9 |

FOREIGN PATENT DOCUMENTS

| | | | |
|---|---|---|---|
| 4914618 | 4/1974 | Japan | 204/9 |

*Primary Examiner*—T. M. Tufariello
*Attorney, Agent, or Firm*—Peter H. Kondo

[57] ABSTRACT

A device is described comprising an elongated electroforming mandrel, the mandrel comprising at least a first segment having at least one mating end and a second segment having at least one mating end, the mating end of the first segment being adapted to mate with the mating end of the second segment, means to temporarily maintain the mating end of the first segment mated with the mating end of the second segment during an electroforming process, each of the segments having a circumferential, electrically conductive electroforming surface located at at least the mating end. This elongated electroforming mandrel may be employed in an electroforming process comprising temporarily mating the segments together, electroforming a metal layer on the electroforming surface of each segment, establishing a parting gap between each metal layer and the underlying segment and removing each metal layer from the underlying segment by sliding the metal layer axially along the underlying segment, the end of the metal layer adjacent the mating end of the underlying segment having a smooth rounded outer edge.

9 Claims, 1 Drawing Sheet

ELECTROFORMING APPARATUS AND PROCESS

BACKGROUND OF THE INVENTION

This invention relates in general to an electroforming mandrel and a process for utilizing the mandrel to prepare hollow electroformed metal articles.

The fabrication of hollow metal articles by an electroforming process is well known. For example, hollow metal articles are fabricated by electrodepositing a metal onto an elongated mandrel which is suspended in an electroyltic bath. The resulting seamless electroformed tubes are thereafter removed from the mandrel by sliding the tube off one end of the mandrel. Different techniques have been developed for forming and removing tubes from electroforming mandrels depending upon the cross-sectional area of the electroformed tube. Examples of these techniques are described, for example, in U.S. Pat. No. 3,844,906 to R. E. Bailey et al and in U.S. Pat. No. 4,501,646 to W. G. Herbert.

A process for electroforming hollow nickel articles having a large crosssectional area onto a mandrel is described in U.S. Pat. No. 3,844,906 to R. E. Bailey et al. More specifically, the process involves establishing an electroforming zone comprising a nickel anode and a cathode comprising a support mandrel, the anode and cathode being separated by a nickel sulfamate solution maintained at a temperature of from about 140° F. (60° C.) to 150° F. (66° C.) and having a current density therein ranging from about 200 to 500 amps/ft$^2$, imparting sufficient agitation to the solution to continuously expose the cathode to fresh solution, maintaining this solution within the zone at a stable equilibrium composition comprising:

Total Nickel: 12.0 to 15.0 oz/gal

Halide as $NiX_2.6H_2O$: 0.11 to 0.23 moles/gal $H_3BO_3$: 4.5 to 6.0 oz/gal electrolytically removing metallic and organic impurities from the solution upon egress thereof from the electroforming zone, continuously charging to the solution about 1.0 to $2.0\times10^{-4}$ moles of a stress reducing agent per mole of nickel electrolytically deposited from the solution, passing the solution through a filtering zone to remove any solid impurities therefrom, cooling the solution sufficiently to maintain the temperature within the electroforming zone upon recycle thereto at about 140° F. (60° C.) to 160° F. (71° C.) at the current density in the electroforming zone, and recycling the solution to the electroforming zone. The thin flexible endless nickel belt formed by this electrolytic process is recovered by cooling the nickel coated mandrel to effect parting of the nickel belt from the mandrel due to different respective coefficients of thermal expansion.

For metal articles fabricated by electroforming on mandrels having a small cross-sectional area, the process described in U.S. Pat. No. 4,501,646 to W. G. Herbert is preferred to overcome difficulties in removing the electroformed article from the mandrel. For example, when the chromium coated aluminum mandrel described in U.S. Pat. No. 3,844,906 is fabricated into electroforming mandrels having very small diameters of less than about 1 inch, metal articles electroformed on these very small diameter mandrels are extremely difficult or even impossible to remove from the mandrel. Attempts to remove the electroformed article can result in destruction or damage to the mandrel or the electroformed article, e.g. due to bending, scratching or denting.

Although electroforming techniques provide excellent hollow metal articles these processes exhibit certain deficiencies. Normally, hollow electroformed articles such as metal tubes or belts are removed from one end of an electroforming mandrel. Each end of these electroformed articles are usually rough and irregular and must be finished by trimming, for cosmetic reasons or to satisfy tolerance requirements. However, trimming the edges of electroformed articles by cutting blades, lasers, or turning on a lathe produce relatively rough edges or sharp edges which often must be coated to blunt the edge. Such trimming steps are undesirable in many commerical applications. When metal articles fabricated by electroforming on mandrels having a small cross-sectional area such as electroformed tubes are to be utilized as shafts, the ends of the tubes must normally be fitted with collets, press fit bearings or other devices which will allow the ends of the shaft to be supported by rods, bearings and the like. The additional cost, difficulty and manufacturing steps required to trim the ends of the electroformed articles prior to insertion of collets, bearings, or other support devices are highly undesirable, particulary when the electroformed tubes have a small diameter opening.

One well known alternative to trimming the ends of an electroformed tube is to mask the electroforming surface of the mandrel to prevent deposition of metal during the electroforming process. However, masking also requires an additional manufacturing operation. Moreover, electroforming masks have a short life and generally adhere poorly to an electroforming surface, particularly when the masking material has a different coefficient of expansion than the electroforming surface. In addition, many mask materials tend to absorb plating bath material and become electrically conductive thereby defeating the function of the mask. Also, the masks are difficult to apply. Often, electroformed metal deposits adjacent masked areas are rough and become progressively rougher as the mask ages. Also, the mask material may smear onto other parts of the mandrel during removal of the electroformed part and cause non-uniform nucleation and roughness of subsequently deposited electroformed articles.

One technique for masking is disclosed, for example, in U.S. Pat. No. 3,830,710 to Narozanski et al in which a flat masked cathode in an electrolytic deposition process of copper is described. Referring to FIG. 3 of the patent, masking member 24 is dove-tailed in shape and is adapted to mate with adjacent edge portions 14 of a flat cathode 10 to produce a smooth-edged surface adjacent the masking member. A "V-groove 17" is also described which causes the copper to deposit in the form of dendrites which grow in directions normal to the sides of the V-groove so that where the dendrites meet in the course of their growth, a plane of weakness is established. The deposited copper sheet fails at the plane of weakness when it is stripped from the flat electrode surface. The process described in this patent utilizes a flat unitary cathode to form copper sheets. The masking member appears to at least occasionally encounter leaks where copper deposits under the mask. The conductive deposits in the V-groove would be difficult to remove for cleaning. In addition, insulating dirt depositing in the groove may function as a mask. Further, it appears that removal of electrodeposited metal on the flat electrode surface requires peeling off of the electroformed material because the electrodeposited material cannot be slid off the end of the flat electrode surface.

In U.S. Pat. No. 3,022,230 to Fialkoff, a masking agent 2 is employed on a conductive mandrel to produce a helical groove 4 on mandrel 1. The usual problems encountered with masks as described above would also be expected using the technique of this patent.

In U.S. Pat. No. 799,634, to Cowper-Coles a cylindrical mandrel contains a fine spiral groove or indentation to allow deposited metal to be wound off the mandrel. Referring to FIG. 5, the metal deposited can be stripped off in a continuous spiral after the required thickness of metal has been deposited upon the mandrel. The mandrel described in this patent utilizes a unitary mandrel to form strips, wires and rods. Moreover, conductive deposits in the groove would be difficult to remove for cleaning. In addition, insulating dirt depositing in the groove may function as a mask. Further, it appears that removal of electrodeposited metal on a cylindrical mandrel requires unwinding of the electroformed material because the feathered extension of the electrodeposited material into the helical groove will prevent sliding of the material off the end of the cylindrical mandrel.

SUMMARY OF THE INVENTION

It is an object of the invention to provide an electroforming apparatus and process for using the apparatus which overcomes the above-noted disadvantages.

It is another object of this invention to provide an electroforming apparatus and process for using the apparatus that reduces the number of manufacturing steps.

It is still another object of this invention to provide an electroforming apparatus and process for using the apparatus which forms articles having improved dimensional tolerances.

It is another object of this invention to provide an electroforming apparatus and process for using the apparatus which is both simple and inexpensive.

It is still another object of this invention to provide an electroforming mandrel which may be reused numerous times without the necessity of masking or cleaning.

It is still another object of this invention to provide an electroforming mandrel which facilitates removal of electroformed articles from the mandrel.

It is still another object of this invention to provide an electroforming mandrel which can be utilized to produce electroformed hollow articles with finished ends that do not require trimming.

It is still another object of this invention to provide an electroforming mandrel which forms an electroformed article having a smooth, rounded edge.

The foregoing objects and other are accomplished in accordance with this invention by providing an elongated electroforming mandrel, the mandrel comprising at least a first segment having at least one mating end and a second segment having at least one mating end, the mating end of the first segment being adapted to mate with the mating end of the second segment, means to temporarily maintain the mating end of the first segment mated with the mating end of the second segment during an electroforming process, each of the segments having a circumferential, electrically conductive electroforming surface located at at least the mating end. This elongated electroforming mandrel may be employed in an electroforming process comprising temporarily mating the segments together, electroforming a metal layer on the electroforming surface of each segment, establishing a parting gap between each metal layer and the underlying segment and removing each metal layer from the underlying segment by sliding the metal layer axially along the underlying segment, the end of the metal layer adjacent the mating end of the underlying segment having a smooth rounded outer edge.

In general, the advantages of this invention will become more apparent upon consideration of the following disclosure of this invention, particulary when taken in conjunction with the accompanying drawings wherein.

Figure 1:
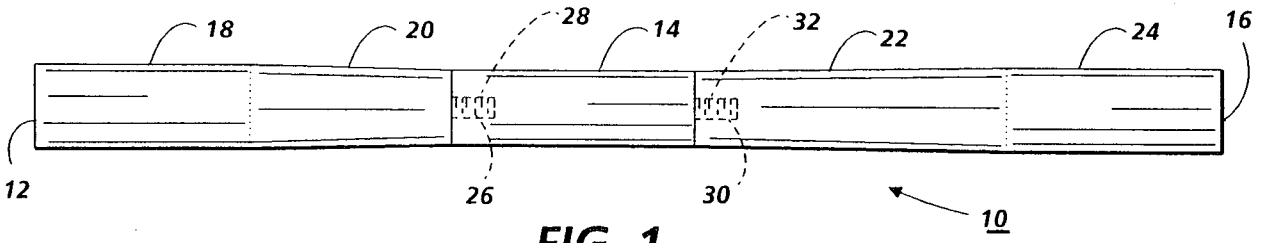
FIG. 1 is a schematic illustration of one embodiment of a segmented electroforming mandrel of this invention.

Referring to FIG. 1, a segmented mandrel 10 is illustrated comprising a first segment 12, a second segment 14, and a third segment 16. The first segment 12 comprises a first section 18 having a uniform outer perimeter along its length and a second section 20 which has the same outer perimeter as first section 18 where it joins with first section 18 and gradually tapers to a slightly smaller outer perimeter where it mates with second segment 14. The outer perimeters of second section 20 and second segment 14 at the point where they join are identical. Second segment 14 has a uniform outer perimeter along its entire length. Third segment 16 is almost a mirror image of first segment 12 More specifically, third segment 16 has a first section 22 having one end with the same outer perimeter as second segment 14 where the two segments mate. The outer surface of section 22 gradually tapers to a slightly larger outer perimeter where it joins with second section 24. Second section 24 has a uniform diameter along its entire length. Segments 12 and 16 need not be tapered, but may, for example, have parallel sides. The outer perimeters of section 22 and second segment 14 at the point where they mate are identical. Segment 12 is temporarily mated to segment 14 by means of a threaded stud 26 permanently mounted to one end of of segment 12. Threaded stud 26 is screwed into a threaded hole 28 located in one end of semgnet 14. Similarly, segment 16 is temporarily mated to segment 14 by means of a threaded stud 30 permanently mounted in one end of of segment 14. Threaded stud 30 is screwed into a threaded hole 32 located in one end of segment 16. A threaded stud or other suitable member (not shown) may, if desired, be mounted on the free end of section 24 for mounting to a support means (not shown) which is adapted to lower the segmented mandrel 10 into and out of an electroforming bath. The bottom end of segment 12 may be masked in a conventional manner or comprise still another removable segment (not shown). After a metal layer is electrodeposited on the electrically conductive surface of the assembled segmented mandrel 10 by conventional electroforming techniques, the mandrel is disassembled and the electrodeposited metal sleeve on segment 14 may be removed by sliding the sleeve off either end of segment 14. The electroformed sleeved formed on tapered segments 12 and 16 may be removed by sliding the sleeve off toward the narrower end of the tapered segments.

Figure 2:
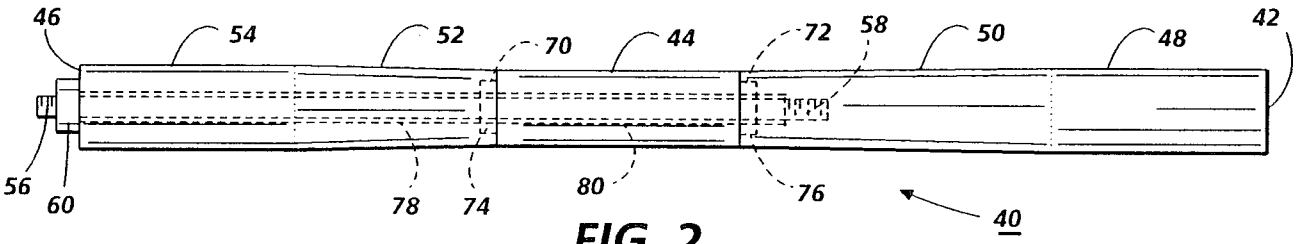
FIG. 2 is a schematic illustration of another embodiment of a segmented electroforming mandrel of this invention.

Referring to FIG. 2, a segmented mandrel 40 is shown comprising a first segment 42, a second segment 44, and a third segment 46. The first segment 42 comprises a first section 48 having a uniform outer perimeter along its length and a second section 50 which has the same outer perimeter as first section 48 where it joins with first section 48 and gradually tapers to a slightly smaller outer perimeter where it mates with second segment 44. The outer perimeters of second section 50 and second segment 44 at the point where they mate are identical. Second segment 44 has a uniform outer perimeter along its entire length. Third segment 46 is almost a mirror image of first segment 42 More specifically, third segment 46 comprises a first section 52 having one end with the same outer perimeter as second segment 44 where it the two segments mate. The outer surface of section 52 gradually tapers to a slightly larger outer perimeter where it joins with second section 54. Second section 54 has a uniform diameter along its entire length. The outer perimeters of section 52 and second segment 44 at the point where they mate are identical. Segments 42, 44 and 46 are temporarily mated by means of a threaded stud 56. One end of threaded stud 56 is screwed into a threaded hole 58 located in one end of segment 42. A nut 60 is screwed onto the other end of threaded stud 56 to compress segments 46 and 44 against segment 42. The portion of threaded stud 56 extending beyond nut 60 may be mounted to a support means (not shown) which is adapted to lower the segmented mandrel 40 into and out of an electroforming bath. The bottom or free end of segment 42 may be masked in a conventional manner or comprise still another removable segment (not shown). After a metal layer is electrodeposited on the electrically conductive surface of the assembled segmented mandrel 40 by conventional electroforming techniques, the mandrel is disassembled and the electrodeposited metal sleeve on segment 44 is removed by sliding the sleeve off either end of segment 44. Surprisingly, the ends of the electroformed sleeve adjacent each of the mating ends of mandrel segment 44 had a smooth rounded outer edge. The electroformed sleeves formed on tapered segments 42 and 46 are removed by sliding the sleeve off toward the narrower end of the tapered segments. Each of the ends of the tapered electroformed sleeves that were previously adjacent the mating ends of mandrel segment 44 also had a smooth rounded outer edge.

Figure 3:
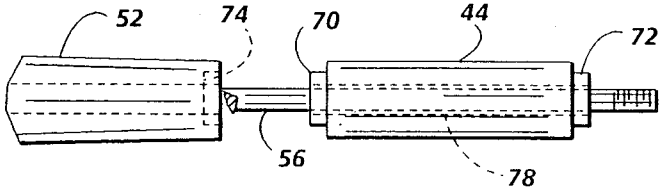
FIG. 3 is a partially exploded view of a portion of the embodiment illustrated in FIG. 2.
Figure 4:
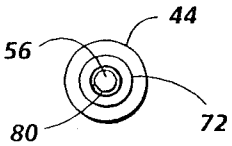
FIG. 4 is an end view of a mandrel segment illustrated in FIG. 3.

An exploded view of segments 44 and 46 is illustrated in FIG. 3 and an end view of segment 44 is shown in FIG. 4 to further provide details of how the mandrel segments may be aligned. Segment 44 is equipped with ring shaped alignment lips 70 and 72 protruding from each end of segment 44. The ends of segments 46 and 42 (see FIG. 2) are provided with recesses 74 and 76, respectively, to precisely receive and align lips 70 and 72, respectively. These alignment means or other equivalent means such as pins on the end of one segment and corresponding receiving holes on the end of an adjacent segment (not shown) and particularly desirable where the diameter of the channel 78 through the segments is much larger than the diameter of the threaded stud 56 such that the space 80 between threaded stud 56 and the adjacent segment hampers facile alignment of adjacent mating ends of adjacent segments.

Although mandrel 10 is illustrated as having a circular cross section, it may have any other suitable configuration such as an oval, polygon (e.g. triangle, square, rectangle, hexagon, octagon, and the like), figure having a scalloped pattern, and the like. For mandrels have a convex polygon cross-sectional shape, the distance across adjacent peaks of the cross-sectional shape is preferably at least twice the depth of the valley between the peaks (depth of the valley being the shortest distance from an imaginary line connecting the peaks to the bottom of the valley) to facilitate removal of the electroformed articles from the mandrels without damaging the articles and to ensure uniform wall thickness. The cross section may be regular in shape or irregular, (e.g., trapezoid) so long as the mating ends of adjacent mandrel segments can be mated in substantially perfect alignment with one another. The mating ends of adjacent mandrel segments are deemed to be mated in substantially perfect alignment when the junction between adjacent segments, during the period of time that the segments are temporarily mated, is free of any groove discernible by passage of the edge of an adult human fingernail. The elongated electroforming mandrels of this invention are generally machined by conventional precison machining techniques so that the junction of the mating ends of the segments are as perfect as possible to ensure that mating ends of adjacent mandrel segments can be mated in substantially perfect alignment. The junction of the mating ends of the segments of the electroforming mandrel of this invention may be visually discernable but, the junction is not discernable by and cannot be detected when an adult human fingernail is passed over the junction. The degree of fineness may be compared to the fact that passage of an adult human fingernail against the grooves of a phonograph record can detect the phonograph record grooves. It is important that the junction of mating ends of the segments of the electroforming mandrel of this invention not be detectable by passage of the edge of an adult human fingernail. This prevents the formation of feathers of electroformed material from the electroformed article from descending into the joint between adjacent mandrel segments. Such feathers prevent the removal of the hollow electroformed article when an attempt is made to slide the article axially off the mandrel segment in a direction away from the end of the mandrel segment joint where the feather was formed, i.e. the feather must be slide over the surface of a mandrel segment during removal of the electroformed article. Additionally, since some electroformed materials (e.g. nickel) are harder than some mandrel materials (e.g. stainless steel), such feathers will scratch the mandrel and eventually render it useless for electroforming.

Although the plane of the mating end of an electroforming mandrel segment is often perpendicular to the axis of the mandrel segment, other angles may be utilized. Furthermore, the surface of a mating end of an electroforming mandrel segment need not consist of a single plane but may comprise complex surfaces positioned at more than one plane such as a step type configuration.

Generally, the mating ends of each mandrel segment should be scrupulously clean at the time they are assembled together. Even small amounts of foreign material cannot be tolerated. Such foreign material can cause bridging of the electroformed metal sleeve across the joints from one mandrel segment to the next, formation of gas during electroforming, and rough deposits at the joint. For example, a human fingerprint formed on the mating end of a mandrel segment can cause bridging between electroformed metal sleeves. Any suitable technique may be employed to clean the mating ends. The degree of cleaning desired depends upon the type of contamination carried on the mating ends of the mandrel segments. Typical cleaning techniques including washing with soap and water followed by a water rinse, solvent cleaning, or the like and combinations thereof. For deposits that are difficult to remove by means of ordinary soap and water or solvents, the mating ends may be scrubbed with any suitable mild cleaning abrasive such as fine aluminum oxide particles having an average particle size of about 0.5 micrometer, e.g. alpha alumina. If an abrasive is used, care should be taken to ensure that all the abrasive particles are removed from the mating ends before the mandrel segments are joined.

The electroforming surface of each mandrel segment should be substantially parallel to the axis of the respective mandrel segment to permit removal of the electroformed article from the mandrel segment, or if tapered, the taper should be toward the end of the mandrel segment from which the electroformed member is removed. In other words, the longitudinal configuration of each segment may includes sides parallel to the segment axis or sides slightly tapered with respect to its axis (e.g. opposite sides gradually converge toward each other). Shapes wherein the electroforming surface of a segment has a pronounced slope (e.g. approaching 90° to the axis of the segment) are considered within the scope of this invention. The mandrel may also comprise two truncated cone shaped segments mated at the ends having the smaller diameter. Still another embodiment comprises two right cylinder segments, one having a diameter twice that of the other, that are joined at a mating end. Another example is a segmented mandrel having the overall shape of a tapered cylinder in which the segments are formed, for example, by one or more slices made perpencidular to the axis of the cylinder. It is important that all of these embodiments meet the fingernail test described above to achieve smooth finished sleeve ends adjacent the mating ends of each segment. Where suitable, the longitudinal configuration of the mandrel segments may include combinations of shapes such as a shallow cone shape combined with a right cylinder shape for each individual segment. It is also important that the shapes selected for the mandrel segments allow the sleeves electroformed thereon to be removed from their respective electroforming mandrel segments after the segments are separated from each other. The length of each mandrel segment may be of the same length as the other segments or one segment may have a different length than the others, if desired. Similarly, as described above, the shape of any given mandrel segment may be the same as or different from the other mandrel segments Although studs are shown to in the drawings to temporarily mate the mandrel segments together during electrodeposition, any other suitable fastening means may be employed. Typical fastening means to temporarily join the mandrel segments during the electroforming process include bolts, studs, magnets, threaded male and female hollow mandrel ends, press fit male and female mandrel end fittings, and the like. If desired, any suitable alignment means may be employed to align the mating ends. Typical alignment means include, for example, pin and hole combinations, ridge and groove combinations, shaft with closely fitting shaft channels, and the like and combinations thereof.

The mandrel segments employed to form the elongated electroformed hollow members having a small cross-sectional area should normally be solid and of large mass or, in a less preferred embodiment, hollow with means to heat the interior to prevent cooling of the mandrel while the deposited coating is cooled. Thus, the mandrel segments have high heat capacity, preferably in the range of from about 3 to about 4 times the specific heat of the corresponding electroformed article material. This determines the relative amount of heat energy contained in the electroformed article compared to that in the mandrel segment. Further, the mandrel segments should exhibit low thermal conductivity to maximize the difference in temperature (Delta T) between the electroformed article and the mandrel segment during rapid cooling of the electroformed article to prevent any significant cooling and contraction of the mandrel segment. In addition, a large difference in temperature between the temperature of the cooling bath and the temperature of the electroformed coating and mandrel segment maximizes the permanent deformation due to the stress-strain hysteresis effect. A high thermal coefficient of expansion is also desirable in a mandrel segment to optimize permanent deformation due to the stress-strain hysteresis effect. Although an aluminum mandrel segment is characterized by a high thermal coefficient of expansion, it exhibits high thermal conductivity and low heat capacity which are less effective for optimum permanent deformation due to the stress-strain hysteresis effect. Typical mandrels include stainless steel, iron plated with chromium or nickel, nickel, titanium, aluminum plated with chromium or nickel, titanium palladium alloys, Inconel 600, Invar and the like. The outer surface of the mandrel should be passive i.e. abhesive, relative to the metal that is electrodeposited to prevent adhesion during electroforming. The mandrel segments may be formed of the same or different metal than the other mandrel segments. This may be desirable, for example, where the physical or chemical properties desired for one mandrel segment differs from that of the the other segments. For electroformed articles having a segmental cross-sectional are of less than about 1.8 square inches (11.6 $cm^2$) the mandrel segment should have an overall length to segmental crosssectional area ratio greater than about 0.6. Thus, a mandrel having a segmental cross-sectional area of about 1.8 square inches would have a length of at least about 1 inch (2.54 cm). There is considerable latitude in the relationship of mandrel crosssectional area to length for mandrels having a large cross-sectional area. Typical mandrels having a large cross-sectional area are described, for example in U.S. Pat. No. 3,844,906 to R. E. Bailey et al. The entire disclosure of U.S. Pat. No. 3,844,906 is incorporated herein by reference.

Any suitable metal capable of being deposited by electroforming and having a coefficient of expansion of between about $6\times10^{-6}$ in/in°F. and about $10\times10^{-6}$ in/in/°F. may be used in the process of this invention. Preferably, the electroformed metal has a ductility of at least about 8 percent elongation. Typical metals that may be electroformed include, nickel, copper, cobalt, iron, gold, silver, platinum, lead, and the like, and alloys thereof.

Generally, the electroformed hollow articles of this invention have relatively thin sleeves. For example, the sleeves may range in thickness from about 0.0005 inch (0.013 mm) to about 0.020 inch (0.05 mm). Normally, thicker sleeve walls are desirable for electroformed hollow articles having relatively large perimeters of more than 7.5 centimeters where flexibility is not a required characteristic.

An opening may be provided in one end of the electroformed member deposited on the end segment to facilitate removal of the electroformed member from the end mandrel by allowing air to enter. The size of the opening is not particularly critical and can be formed by any suitable conventional technique such as masking an area at the free end of a mandrel segment. However, if desired, an opening may be omitted where, for example, the electroformed member is removed from the mandrel at a rate which allows air to bleed in through the parting gap to compensate for any partial vacuum formed, or where an end mask is utilized.

An adequate parting gap may be obtained even for electroformed articles having a small diameter or small cross-sectional area by controlling the stress-strain hysteresis characteristics of the electroformed article. For example, sufficient hysteresis alone may be utilized to achieve an adequate parting gap to remove an electroformed article from a mandrel having a diameter of about 1.5 inches (3.8 cm) in the absence of any assistance from internal stress characteristics of the electroformed article of from any difference in thermal coefficients of expansion of the electroformed article and mandrel. The internal stress of an electroformed article includes tensial stress and the compressive stress. In tensial stress, the material has a propensity to become smaller than its current size. This is believed to be due to the existence of many voids in the metal lattice of the electroformed deposit with a tendency of the deposited material to contract to fill the voids. However, if there are many extra atoms in the metal lattice instead of voids, such as metal atoms or foreign materials, there is a tendency for the electroformed material to expand and occupy a larger space.

Stress-strain hysteresis is defined as the stretched (deformed) length of a material in inches minus the original length in inches divided by the original length in inches. The stress-strain hysteresis characteristics of the electroformed articles having a small diameter or small cross-sectional area can be maximized at about 0.00015 in/in (0.00015 cm/cm).

The hysteresis characteristics of a given electroformed material may be controlled by adjusting the electroforming process conditions and the composition of the electroforming bath. Control involves adjusting the pH, metal component concentration, bath temperature, speed of core mandrel rotation, and the like. With each adjustment, a hysteresis stress strain curve is plotted for the product prepared with a given bath composition and the electroforming process conditions. Alterations are then again made to the electroforming process conditions and/or the composition of the electroforming bath until the hysteresis of the stress-strain curve is maximized.

When electroforming nickel articles having a small diameter or small cross-sectional area, the pH of the bath should be between about 3.75 and about 3.95 with optimum hysteresis characteristics being achieved at a pH of about 3.85. The relationship of nickel bath pH control to hysteresis may be determined, for example, by cutting rectangular samples from electroformed nickel articles prepared on 1 inch (2.54 cm) diameter stainless steel (304) mandrels having a length of about 24 inches (61 cm) in different electroforming baths maintained at 140° F. (60° C.) and nickel concentration of 11.5 oz/gal (86 g/l) but held at different pH values and plotting these data against the pH value of the bath in which each electroformed nickel article was made. A parting temperature of about 40° F. (4° C.) was employed. In order to remove an electroformed article from a core mandrel having a segmental cross-sectional area of less than about 1.8 square inches (11.6 $cm^2$) and an overall length to segmental cross-sectional area ratio greater than about 0.6, the stress-strain hysteresis must be at least about 0.00015 in/in (0.00015 cm/cm) between about 135° F. (57° C.) and about 145° F. (63° C.) with optimum hysteresis being achieved at a bath temperature of about 140° F. (60° C.). In order to remove an electroformed article from a core mandrel having a segmental crosssectional area of less than about 1.8 square inches (11.6 $cm^2$) and an overall length to segmental cross-sectional area ratio greater than about 0.6, the stress-strain hysteresis must be at least about 0.00015 in/in (0.00015 cm/cm).

A preferred concentration of nickel for electroforming nickel articles having a segmental cross-sectional area of less than about 1.8 square inches (11.6 $cm^2$) and an overall length to segmental cross-sectional area ratio greater than about 0.6, should be between about 11 oz/gal (83 g/l) and about 12 oz/gal (90 g/l) with optimum being about 11.5 oz/gal (86 g/l).

When the boric acid concentration drops below about 4 oz/gal (30 g/l), bath control diminishes and surface flaws increase. The boric acid concentration is preferably maintained at about the saturation point at 100° F. (38° C.). Optimum hysteresis may be achieved with a boric acid concentration of about 5 oz. per gallon (37.5 g/l). When the boric acid concentration exceeds about 5.4 oz/gal (40.5 g/l), precipitation can occur in localized cold spots thereby interfering with the electroforming process.

To minimize surface flaws such as pitting, the surface tension of the plating solution is adjusted to between about 33 dynes per square centimeter to about 37 dynes per square centimeter. The surface tension of the solution may be maintained within this range by adding an anionic surfactant such as sodium lauryl sulfate, sodium alcohol sulfate (Duponol 80, available from E. I. duPont de Nemours and Co., Inc.), sodium hydrocarbon sulfonate (Petrowet R, available from E. I. duPont de Nemours and Co., Inc.) and the like. Up to about 0.014 oz/gal (0.1 g/l) of an anionic surfactant may be added to the electroforming solution. The surface tension in dynes per centimeter is generally about the same as that described in U.S. Pat. No. 3,844,906. The concentration of sodium lauryl sulfate is sufficient to maintain the surface tension at about 33 dynes per centimeter to about 37 dynes per centimeter.

Saccharine is a stress reliever. However, in a concentration of more than about 2 grams per liter, it causes nickel oxide to form as a green powder rather than as a nickel deposit on core mandrels. At concentrations of about 1 gram per liter the deposited nickel layer will often become so compressively stressed that the stress will be relieved during deposition causing the deposit to be permanently wrinkled. Consequently, one cannot depend on adding large quantities of saccharine or other stress reducers to an electroforming bath to produce the desired parting gap. Additionally, saccharine renders the deposit britle thus limiting its uses.

A preferred current density is between about 300 amps per square foot (0.325 amps/$cm^2$) and about 400 amps per square foot (0.43 amps/cm$^2$). Higher current densities may be achieved by increasing the electrolyte flow, mandrel rotational speed, electrolyte agitation, and cooling. Current densities as high as 900 amps per square foot (0.968 amps/cm$^2$) have been demonstrated.

Parting conditions are also optimized by cooling the outer surface of the electroformed articles rapidly to cool the entire deposited coatings prior to any significant cooling and contracting of the mandrel segments permanently deform the electroformed article. The rate of cooling should be sufficient to impart a stress in the electroformed articles of between about 40,000 psi (2,818 kg/cm$^2$) and about 80,000 psi (5,636 kg/cm$^2$) to permanently deform the electroformed articles and to render the length of the inner perimeter of the electroformed articles incapable of contracting to less than 0.04 percent greater than the length of the outer perimeter of the resepctive mandrel segment after the mandrel segments are cooled.

The difference in temperature between the electroformed coating and the outer cooling medium must be sufficiently less than the difference in temperature between the cooling medium and the temperature of the mandrel during the stretching phase of the process to achieve sufficient permanent deformation of each electroformed article. Nickel has a low specific heat capacity and a high thermal conductivity. Thus, when an assembly of an electroformed cylindrical nickel article on a solid stainless steel core mandrel segment, such as 304 stainless steel, having a diameter of about 1 inch (2.54 cm) originally at a temperature of 140° F. (60° C.) is cooled by immersion in a liquid bath at a temperature of about 40° F. (4° C.), the temperature of the electroformed article may be dropped to 40° F. (4° C.) in less than 1 second whereas the mandrel segment itself requires 10 seconds to reach 40° F. (4° C.) after immersion. However, because of the rapid rate of cooling and contraction of thin walled mandrels, an electroformed article cannot be removed from the mandrel segment by utilizing a cooling medium surrounding the outer surface of the electroformed article where the mandrel segment has a segmental cross-sectional area of less than about 1.8 square inches (11.6 cm$^2$) and an overall length to segmental cross-sectional area ratio greater than about 0.6.

The electroforming process of this invention for forming electroformed articles may abe conducted in any suitable electroforming device. For example, a solid cylindrically shaped mandrel comprising two or more substantially perfectly mated segments fastened together with threaded studs may be suspended vertically in an electroplating tank. The mandrel segments are constructed of electrically conductive material that are compatible with the metal plating solution. For example, the mandrel may be made of stainless steel. The top edge of the mandrel may be masked off with a suitable nonconductive material, such as wax to prevent deposition or may comprise a short segment which serves as a buffer area from which any electroformed deposit may be removed after electroforming and disposed of as scrap. The mandrel segments may be of any suitable cross section including circular, rectangular, triangular and the like. The electroplating tank is filled with a plating solution and the temperature of the plating solution is maintained at the desired temperature. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the segmented mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank and immersed in a cold water bath. The temperature of the cold water bath should be between about 80° F. (27° C.) and about 33° F. (0.5° C.). When the mandrel is immersed in the cold water bath, the deposited metal is cooled prior to any significant cooling and contracting of the solid mandrel to impart an internal stress of between about 40,000 psi (2,818 kg/cm$^2$) and about 80,000 psi (5,636 kg/cm$^2$) to the deposited metal. Since the metal cannot contract and is selected to have a stress-strain hysteresis of at least about 0.00015 in/in (0.00015 cm/cm), it is permanently deformed so that after the mandrel is cooled and contracted, the deposited metal articles may be removed from the mandrel segments. The deposited metal articles do not adhere to the mandrel segments since the mandrel is selected from a passive material. Consequently, as the mandrel shrinks after permanent deformation of the deposited metal, the deposited metal articles may be readily slipped off the corresponding mandrel segments.

A suitable electroforming apparatus for carrying out the process described above except for use of a segmented mandrel is described, for example, in U.S. Pat. No. 3,954,568 (British Pat. No. 1,288,717, published Sept. 13, 1972). The entire disclosure of this U.S. Patent is incorporated herein by reference.

A typical electrolytic cell for depositing metals such as nickel may comprise a tank containing a rotary drive means including a mandrel supporting drive hub centrally mounted thereon. The drive means may also provide a low resistance conductive element for conducting a relatively high amperage electrical current between the mandrel and a power supply. The cell is adapted to draw, for example, a peak current of about 3,000 amperes DC at a potential of about 18 volts. Thus, the mandrel comprises the cathode of the cell. An anode electrode for the electrolytic cell comprises an annular shaped basket containing metallic nickel which replenishes the nickel electrodeposited out of the solution. The nickel used for the anode comprises sulfur depolarized nickel. Suitable sulfur depolarized nickel is available under the tradenames, "SD" Electrolytic Nickel and "S" Nickel Rounds from International Nickel Co. Nonsulfur depolarized nickel can also be used such as carbonyl nickel, electrolytic nickel and the like. The nickel may be in any suitable form or configuration. Typical shapes include buttons, chips, squares, strips and the like. The basket is supported within the cell by an annular shaped basket support member which also supports an electroforming solution distributor manifold or sparger which is adapted to introduce electroforming solution to the cell and effect agitation thereof. A relatively high amperage current path within the basket is provided through a contact terminal which is attached to a current supply bus bar.

Electroforming may be carried out in a nickel sulfamate solution treating loop. For example, articles can be electroformed by preheating a solid electrically conductive segmented mandrel at a preheating station. Preheating can be effected by contacting the mandrel with a nickel sulfamate solution at about 140° F. (60° C.) for a sufficient period of time to bring the solid mandrel to about 140° F. (60° C.). Preheating in this manner allows the mandrel to expand to the dimensions desired in the electroforming zone and enables the electroforming operation to begin as soon as the mandrel is placed in the electroforming zone. Thereafter, the mandrel is transported from the preheating station to an electroforming zone. The electroforming zone may comprise at least one cell containing an upstanding electrically conductive rotatable spindle which is centrally located within the cell and a concentrically located container spaced therefrom which contains donor metallic nickel. The cell is filled with nickel sulfamate electroforming solution. The mandrel is positioned on the upstanding electrically conductive rotatable spindle and is rotated thereon. A DC potential is applied between the rotating mandrel cathode and the donor metallic nickel anode for a sufficient period of time to effect electrodeposition of nickel on the mandrel to a predetermined thickness of at least 30 Angstroms. Upon completion of the electroforming process, the mandrel and the nickel articles formed thereon are transferred to a nickel sulfamate solution recovery zone. Within this zone, a major portion of the electroforming solution dragged out of the electroforming cell is recovered from the articles and mandrel. Thereafter, the electroformed articles bearing mandrel is transferred to a cooling zone containing water maintained at about 40° C. (4° C.) to 80° C. (27° C.) or cooler for cooling the mandrel and the electroformed articles whereby the electroformed articles are cooled prior to any significant cooling and contracting of the mandrel segments whereby a stress of between about 40,000 psi (2,818 kg/cm$^2$) and about 80,000 psi (5,636 kg/cm$^2$) is imparted to each cooled electroformed article to permanently deform each electroformed article and to render the length of the inner perimeter of each electroformed article incapable of contracting to less than about 0.4 percent greater than the length of the outer perimeter of the corresponding mandrel segment after the core mandrel is cooled and contracted. Cooling is then continued to cool and contract the solid mandrel segments. After cooling, the mandrel and electroformed articles are passed to a parting and cleaning station at which the electroformed articles are removed from the mandrel, sprayed with water and subsequently passed to a dryer. Generally, the mandrel segments need not be separated from each other prior to removal of the electroformed articles. However, such separation prior to removal of the electroformed articles may be desirable where the mandrel comprises a large number of segments with numerous feathers or the shape of one or more mandrel segments requires separation prior to removal of the electroformed articles (e.g. two adjacent segments having electroforming surfaces tapering toward a common mating junction). The mandrel is sprayed with water, checked for cleanliness, and reassembled before being recycled to the preheat station to commence another electroforming cycle. Electroformed articles must have a stress-strain hysteresis of at least about 0.00015 in/in (0.00015 cm/cm). Moreover, the electroformed articles must have an internal stress of between about 1,000 psi tensile and about 15,000 compressive, i.e.

$$+1{,}000 \text{ psi}$$

$$0 \text{ psi} \frac{\uparrow \text{Tensile}}{\downarrow \text{Compressive}}$$

$$-15{,}000 \text{ psi}$$

to permit rapid parting of the electroformed articles from the respective mandrel segment. The electroformed articles must have a thickness of at least about 30 Angstroms in order to allow sufficient permanent deformation utilizing the stress-strain hysteresis characteristics of the electroformed articles.

Very high current densities are employed with a nickel sulfamate electroforming solution. Generally, the current densities range from about 150 amps per square foot (0.16 amps/cm$^2$) to about 500 amps per square foot (0.53 amps/cm$^2$), with a preferred current density of about 300 amps per square foot (0.32 amps/cm$^2$). Current concentrations generally range from about 5 amps per gallon (1.2 amps/l) to about 20 amps per gallon (5 amps/l).

At the high current density and high current concentration, a great deal of heat is generated in the metal or metal alloy electroforming solution within the electroforming cell for small sectional area hollow articles. This heat must be removed in order to maintain the solution temperature within the cell in the range of about 135° F. (57° C.) to about 145° F. (63° C.), and preferably at about 140° F. (60° C.). At temperatures below about 135° F. (57° C.), there is a sufficient decrease in the desired stress strain hysteresis needed for removal of the electroformed nickel article from the mandrel without damaging the mandrel or the article. At temperatures of above about 160° F. (71° C.), hydrolysis of the nickel sulfamate occurs under the acid conditions maintained in the solution resulting in the generation of $NH_4+$ which is detrimental to the process as it increases tensile stress and reduces ductility in the nickel article.

Because of the significant effects of both temperature and solution composition on the final small cross-sectional area product as discussed herein, it is necessary to maintain the electroforming solution in a constant state of agitation thereby substantially precluding localized hot or cold spots, stratification and inhomogeneity in the composition. Moreover, constant agitation continuously exposed the mandrel segments to fresh solution and, in so doing, reduces the thickness of the cathode film thus increasing the rate of diffusion through the film and thus enhancing nickel deposition. Agitation is maintained by continuous rotation of the mandrel and by impingement of the solution of the mandrel segments and cell walls as the solution is circulated through the system. Generally, the solution flow rate across the mandrel segment surfaces can range from about 4 linear feet per second (122 linear cm/sec) to about 10 linear feet per second (305 linear cm/sec). For example, at a current density of about 300 amps per square foot with a desired solution temperature range within the cell of about 138° F. (59° C.) to about 142° F. (61° C.), a flow rate of about 20 gal/min (80 l/min) of solution has been found sufficient to effect proper temperature control. The combined effect of mandrel rotation and solution impingement assures uniformity of composition and temperature of the electroforming solution within the electroforming cell.

For continuous, stable operation to achieve a stress-strain hysteresis of at least about 0.00015 in/in (0.00015 cm/cm), the composition of the aqueous nickel sulfamate solution within the electroforming zone should be as follows:

Total nickel: 11 to 12 oz/gal (82.5–90 g/l)
H3BO3: 4 to 5 oz/gal (30–37.5 g/l)
pH: 3.80 to 3.90
Surface Tension: 33 to 37 dynes/cm2.

A metal halide, generally a nickel halide such as nickel chloride, nickel bromide, or nickel fluoride and preferably, nickel chloride, are included in the nickel sulfamate electroforming solution to avoid anode polarization. Anode polarization is evidenced by gradually decreasing pH during operation.

The pH of the nickel electroforming solution should be between about 3.8 and about 3.9. At a pH of greater than about 4.1 surface flaws such as gas pitting increase. Also, internal stress increases and interferes with parting of the electroformed belt from the mandrel. At a pH of less than about 3.5, the metallic surface of the mandrel segments can become activated, especially when chromium plated mandrel segments are employed, thereby causing the metal electroformed to adhere to the chromium plating. Low pH also results in lower tensile strength. The pH level may be maintained by the addition of an acid such as sulfamic acid, when necessary. Control of the pH range may also be assisted by the addition of a buffering agent such as boric acid within a range of about 4 oz/gal (30 g/l) to about 5 oz/gal (37.5 g/l).

In order to maintain a continuous steady state operation, the nickel sulfamate electroforming solution can be continuously circulated through a closed solution treating loop. This loop may comprise a series of processing stations which maintain a steady state composition of the solution, regulate the temperature of the solution and remove any impurities therefrom.

The electroforming cell may contain, for example, one wall thereof which is shorter than the others and acts as a weir over which the electroforming solution continuously overflows to a trough as recirculating solution is continuously pumped into the cell via a solution distributor manifold or sparger along the bottom of the cell. The solution flows from the electroforming cell via the trough to an electropurification zone and a solution sump. The solution is then pumped to a filtration zone and to a heat exchange station and is then recycled in purified condition at a desired temperature and composition to the electroplating cell whereupon that mixture with the solution contained therein in a steady state condition set forth above are maintained on a continuous and stable basis.

The electrolytic zone removes the dissolved nobel metallic impurites from the nickel sulfamate solution prior to filtering. A metal plate of steel, or preferably stainless steel, can be mounted in the electrolytic zone to function as the cathode electrode. Anodes can be provided by a plurality of anode baskets which comprise tubular shaped metallic bodies, preferably titanium, each having a fabric anode bag. A DC potential can applied between the cathodes and the anodes of the purification station from a DC source. The electropurification zone can include a wall which extends coextensively with the wall of the solution sump zone and functions as a weir.

The solution can be replenished by the automatic addition of deionized water from a suitable source and/or by recycling solution from a nickel rinse zone. A pH meter can be employed for sensing the pH of the solution and for effecting the addition of an acid such as sulfamic acid when necessary to maintain essentially constant pH. The stress reducing agents and surfactant can be continuously added by suitable pumps.

The electroforming solution which flows from the electroforming cell is raised in temperature due to the flow of relatively large currents therein and accompanying generation of heat in the electroforming cell. Means may be provided at a heat exchanging station for cooling the electroforming solution to a lower temperature. The heat exchanger may be of any conventional design which receives a coolant such as chilled water from a cooling or refrigerating system. The electroplating solution which is cooled in the heat exchanger means can be successively pumped to a second heat exchanger which can increase the temperature of the cool solution to within relatively close limits of the desired temperature. The second heat exchanger can be heated, for example, by steam derived from a steam generator. The first cooling heat exchanger can, for example, cool the relatively warm solution from a temperature of about 145° F. (63° C.) or above to a temperature of about 135° F. (57° C.). A second warming heat exchange can heat the solution to a temperature of 140° F. (60° C.). The efflux from the heat exchange station can then be pumped to the electroforming cell.

By manipulating the bath parameters such as the addition of enhancers, altering pH, changing the temperatures; adjusting the cation concentration of the electroforming bath, regulating current density, one may alter the stress-strain hysteresis of the electroformed article. Thus the conditions are experimentally altered until a deposited electroformed article is characterized by a stress-strain hysteresis of at least about 0.00015 in/in (0.00015 cm/cm). For example, when electroforming nickel, the relative quantity of enhancers such as saccharine, methylbenzene sulfonamide, the pH, the bath temperature, the nickel cation concentration, and the current density may be adjusted to achieve a stress-strain hysteresis of at least about 0.00015 in/in (0.00015 cm/cm). Current density affects the pH and the nickel concentration. Thus, if the current density increases, the nickel is unable to reach the surfaces of the mandrel segments at a sufficient rate and the ½ cell voltage increases and hydrogen ions deposit thereby increasing the hydroxyl ions remaining in the bath thereby increaseing the pH. Moreover, increasing the current density also increases the bath temperature.

In order to achieve a sufficient parting gap with hollow electroformed articles having a segmental cross-sectional area less than about 1.8 square inches (11.6 $cm^2$) and an overall length to segmental cross-sectional area ratio greater than about 0.6, the electroformed coating should have a thickness of at least about 30 Angstroms and a stress strain hysteresis of at least about 0.00015 in/in (0.00015 cm/cm). Moreover, the exposed surface of the electroformed article on the mandrel segment must be rapidly cooled prior to any significant cooling and contracting of the mandrel segment.

In a typical electroforming process, a mandrel was utilized comprising three segments similar to that illustrated in FIGS. 2 through 4. The first segment comprised a lower free end and a upper mating end having mounted therein a long threaded stud. This first segment had an overall length of 6.913 inches (17.559 cm), a diameter of 1.357 inches (3.432 cm) at the lower free end, the other end gradually tapering for a distance of about 3.543 inches (8.999 cm) to a diameter of about 1.351 inches (3.432 cm). The second segment of this electroforming mandrel had a length of 3.937 inches (10 cm) and a uniform diameter along its length of 1.351 inches (3.432 cm). One end of the second segment had a ring shaped projection adapted to be inserted into a complementary shaped recess in the mating end of the first segment. The other end of the second segment had a ring shaped projection identical to that on the opposite end of the second segment. The third segment had an overall length of 8.819 inches (22.4 cm), a diameter of 1.357 inches (3.447 cm) at one end and tapered for a distance of 5.118 inches (13 cm) to a diameter of about 1.351 inchdes (3.432 cm). The end of the third segment having a diameter of 1.351 inches (3.432 cm) contained a recess having a shape complementary to the ring shaped projection on either mating end of the second segment. The free end of the threaded stud was inserted through an axial channel extending through the second and third segments and the assembled segments were tightly joined by screwing a nut on the free end of the threaded stud. The ring shaped projections and complementary shaped recesses ensured alignment substatially perfect mating of the mating ends of the joined segments. Although significant changes in the plane of the outer mandrel surface relative to the mandrel axis can be sensed by sliding the edge of an adult fingernail in an axial direction along the outer surface of the mandrel, the joints between the segments could not be detected by such sliding of the fingernail across the joints. A small region of the lower end of the mandrel was masked. All but a small region of the top of segmented mandrel was thereafter immersed in an electroforming bath and a thin layer of nickel was deposited around all the segments by electroforming. The resulting three electroformed sleeves were easily removed from the respective mandrel segments by unscrewing the nut, separating the segments and sliding the sleeves of a mating end of the respective mandrel segment.

DESCRIPTION OF PREFERRED EMBODIMENTS

The following examples further define, describe and compare exemplary methods of preparing the electroformed articles of the present invention. Parts and percentages are by weight unless otherwise indicated. The examples are also intended to illustrate the various preferred embodiments of the present invention. Unless indicated otherwise, all mandrels are cylindrically shaped with sides parallel to the axis. Except as noted in each Example, the general process conditions for the following Examples were constant and are set forth below:

Current Density: 285 - amps/ft$^2$ (305 amps/cm$^2$)
Agitation Rate (solution flow over the cathode surface): 4–6 linear ft/sec (122–183 cm/sec)
pH: 3.8–3.9
Surface Tension: 33–39 dynes/cm
$H_3BO_3$: 4–5 oz/gal (30–37.5 g/l)
Solidum Lauryl Sulfate: 0.0007 oz/gal (0.005 g/l).

Also, all the segmented mandrels were masked at the bottom end with a one inch (2.54 cm) wide Scotch Brand Plater's tape.

EXAMPLE I

Hollow metal articles comprising elongated electroformed hollow members were prepared with the aid of an elongated, segmented, cylindrical mandrel. The segmented mandrel comprised a supported end and a free end. The mandrel segments included a circumferential, cylindrical electroforming surface on a first segment extending from slightly below the supported end to a mating surface on the opposite end of the first segment, a circumferential, cylindrical electroforming surface on a second segment extending from the mating surface of the first segment to a mating surface on the opposite end of the second segment, and a circumferential, cylindrical electroforming surface on a third segment extending from the mating surface of the second segment to the masked opposite end of the third segment. The three segments were temporarily fastened together at the mating surfaces by press fitting the segments together and drawing the segments tightly together with a threaded rod, one end of the rod being screwed into a threaded end of the third segment and the other end of the rod extending beyond the free end of the first segment and secured by a nut. A similar arrangement is illustrated in FIGS. 2 through 4 of the drawings. The mating surfaces of the mandrel segments were precisely machined to achieve substantially perfect alignment between the adjacent mandrel segments so that the resulting joints between the assembled mandrel segments could not be detected by sliding the edge of an adult fingernail over the joints between the mandrels. Prior to assembly, the entire outer surface of each of the segments, including the mating ends were washed with soap and water, polished with alpha alumina (fine aluminum oxide particles having an average particle size of about 0.5 micrometers) and rinsed with water. The dimensions of the mandrel segments are set forth in the tables below. The upper end of the assembled mandrel was secured to a support and transported downwardly into an electroplating bath until all but about 1.5 inches (3.8 cm) of the top of the mandrel was immersed.

First Mandrel Segment material: stainless steel (304)
First Mandrel Segment Perimeter: 3.14 inches (7.98 cm)
First Mandrel Segment cross sectional shape: round
First Mandrel Length: 10 inches (25.4 cm)
Second Mandrel Segment material: stainless steel (304)
Second Mandrel Segment Perimeter: 3.14 inches (7.98 cm)
Second Mandrel Segment cross sectional shape: Round
Second Mandrel Length: 10 inches (25.4 cm)
Third Mandrel Segment material: stainless steel (304)
Third Mandrel Segment Perimeter: 3.14 inches (7.98 cm)
Third Mandrel Segment cross sectional shape: Round
First Mandrel Length: 10 inches (25.4 cm)
Ni (oz/gal): 11.5
$NiCl_2.6H_2O$ (oz/gal): 6
Anode: electrolytic
Plating Temp. ($T_2$): 140° F. (60° C.)
Delta T ($T_2-T_1$): 100
Parting Gap (in.) for 1st segment: 0.00015 (0.0038 mm)
Parting Gap (in.) for 2nd segment: 0.00015 (0.0038 mm)

Parting Gap (in.) for 3rd segment: 0.00015 (0.0038 mm)
Thickness of 1st segment: 0.004 in (0.1 mm)
Thickness of 2nd segment: 0.004 in (0.1 mm)
Thickness of 3rd segment: 0.004 in (0.1 mm)
$T_1$ (Parting Temp.): 40° F. (4° C.)
Saccharin Concentration: 0
2-MBSA/Saccharine: 0
Mole Ratio - Saccharine/Ni: 0
Surface Roughness (micro inches, RMS) 1st Segment: 2
Surface Roughness (micro inches, RMS) 2nd Segment: 2
Surface Roughness (micro inches, RMS) 3rd Segment: 2
Internal Stress, psi: −3,000
Tensile Strength, psi: 93,000
Elongation (percent in 2 in): 12.

After deposition of the metal layer, the segmented mandrel was disassembled and each electroformed sleeve was easily slid off one end of the corresponding mandrel segment by hand. Examination of the ends of each electroformed sleeve that terminated at a joint between the mandrel segments revealed that each sleeve end was so smooth and rounded that no trimming or further finishing was needed.

EXAMPLE II

Hollow metal articles comprising elongated electroformed hollow members were prepared with the aid of an elongated, segmented, cylindrical, chromium plated mandrel. The segmented mandrel had a supported end and a free end. The mandrel segments includes a circumferential, square electroforming surface on a first segment extending from slightly below the supported end to a mating surface on the opposite end of the first segment, a circumferential, square electroforming surface on a second segment extending from the mating surface of the first segment to a mating surface on the opposite end of the second segment, and a circumferential, square electroforming surface on a third segment extending from the mating surface of the second segment to the masked opposite end of the third segment. The three segments were temporarily fastened together at the mating surfaces by drawing the segment ends together with a threaded rod and nut arrangement similar to that illustrated in FIGS. 2 through 4 of the drawings. The mating surfaces of the mandrel segments were precisely machined to achieve substantially perfect alignment between the adjacent mandrel segments so that the resulting joints between the mandrel segments could not be detected by sliding the edge of an adult fingernail over the joints between the mandrels. Prior to assembly, the entire outer surface of each of the segments, including the mating ends were washed with soap and water and then rinsed with water. The dimensions of these mandrel segments are also set forth in the tables below. This mandrel was fastened to a support and lowered into an electroplating bath until all but about 1.5 inches (3.8 cm) of the top of the mandrel was immersed.

First Mandrel Segment materials: Chromium plated aluminum
First Mandrel Segment Perimeter: 4 inches (10 cm)
First Mandrel Segment cross sectional shape: Square
First Mandrel Length: 3 inches (7.6 cm)
Second Mandrel Segment material: Chromium plated aluminum
Second Mandrel Segment Perimeter: 4 inches (10 cm)
Second Mandrel Segment cross sectional shape: Square
Second Mandrel Length: 16 inches (40.6 cm)
Third Mandrel Segment material: Chromium plated aluminum
Third Mandrel Segment Perimeter: 4 inches (10 cm)
Third Mandrel Segment cross sectional shape: Square
Third Mandrel Length (inches): 2 inches (5.1 cm)
Ni (oz/gal): 11.5
$NiCl_2.6H_2O$ (oz/gal): 6
Anode: electrolytic
Plating Temp. $T_2$: 140° F. (60° C.)
Delta T ($T_2-T_1$): 100° F. (38° C.)
Parting Gap for 1st segment at 40° C.: 0.00020 inch (0.005 mm)
Parting Gap for 2nd segment at 40° C.: 0.00020 inch (0.005 mm)
Parting Gap for 3rd segment at 40° C.: 0.00020 inch (0.005 mm)
Thickness of 1st segment: 0.006 inch (0.152 mm)
Thickness of 2nd segment: 0.006 inch (0.152 mm)
Thickness of 3rd segment: 0.006 inch (0.152 mm)
$T_1$ (Parting Temp.): 40° F. (60° C.)
Saccharin Concentration: 0
2-MBSA/Saccharine: 0
Mole Ratio - Saccharine/Ni: 0
Surface Roughness (micro inches, RMS) 1st Segment: 3
Surface Roughness (micro inches, RMS) 2nd Segment: 3
Surface Roughness (micro inches, RMS) 3rd Segment: 3
Internal Stress: −3,000 psi (−210 kg/cm$^2$)
Tensile Strength: 90,000 psi (6,300 kg/cm$^2$)
Elongation (percent in 2 in): 14% in 2 in (5.1 cm).

After deposition of the metal layer, each electroformed sleeve was easily slid off the upper end of the segmented mandrel by hand. The segmented mandrel was not disassembled during the entire process so the mating surfaces remained protected and uncontaminated by foreign material and the mandrel was reused to electroform additional sleeves without any further cleaning of the mating surfaces of the segments. Examination of the ends of each electroformed sleeve that terminated at a junction between the mandrel segments revealed that each sleeve end was so smooth and rounded that no trimming or further finishing was needed.

EXAMPLE III

The procedures described in Example I were repeated with the same mandrel and identical materials and conditions except that after the mandrel segments were cleaned, but before the segments were joined, the mating ends of the mandrel segments were contacted with human fingers to form fingerprints thereon. After electroforming was completed, it was discovered that the deposited nickel layer had bridged the joints between the mandrel segments thereby joining together the sleeves on each of the mandrel segments. A cutting operation was necessary to separate the sleeves from each other. This illustrates the importance of clean segment mating surfaces.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An electroforming process comprising providing an elongated electroforming mandrel, said mandrel comprising a first segment having at least one mating end and at least a second segment having at least one mating end, said mating end of said first segment being adapted to mate with said mating end of said second segment, means to temporarily maintain said mating end of said first segment mated with said mating end of said second segment during an electroforming process, each of said segments having a circumferential, electrically conductive electroforming surface located at at least said mating end, temporarily mating said mating end of said first segment with said mating end of said second segment in substantially perfect alignment to form a junction free of any groove discernible by passage of the edge of an adult human fingernail, electroforming a metal layer on said electroforming surface of said first segment, said metal layer adjacent said mating end of the underlying first segment having a smooth rounded outer edge and electroforming a metal layer on said electroforming surface of said second segment, said metal layer adjacent said mating end of the underlying second segment having a smooth rounded outer edge, establishing a parting gap between said metal layer and said underlying first segment, establishing a parting gap between said metal layer and said underlying second segment, and removing said metal layers from said underlying segments by sliding said metal layers axially along said underlying segments, the end of said metal layers adjacent said mating ends of said underlying segments having a smooth rounded outer edge.

2. An electroforming process according to claim 1 wherein said first segment has a second mating end and said circumferential, electrically conductive electroforming surface extends to said second mating end.

3. An electroforming process according to claim 1 wherein said elongated electroforming mandrel also comprises a third segment having a mating end and said second segment has a second mating end adapted to mate with said mating end of said third segment in substantially perfect alignment to form a junction free of any groove discernible by passage of the edge of an adult human fingernail.

4. An electroforming process according to claim 1 including cleaning said mating ends to remove any foreign material including human fingerprints prior to temporarily mating said mating end of said first segment with said mating end of said second segment.

5. An electroforming process according to claim 1 including separating said first segment from said second segment prior to removing said metal layers from said underlying segments.

6. An electroforming process according to claim 1 including separating said first segment from said second segment subsequent to removing said metal layers from said underlying segments.

7. An electroforming process according to claim 1 including electroforming said metal layers on said electroforming surfaces of said fisrt segment and said second segment until said metal layers have a thickness of between about 0.013 millimeters and about 0.05 millimeters.

8. An electroforming process according to claim 1 including, after removing said metal layers from said underlying segments by sliding said metal layers axially along said underlying segment, electroforming a new metal layer on said electroforming surface of said first segment and electroforming a new metal layer on said electroforming surface of said second segment, establishing a parting gap between said new metal layer and the underlying first segment, establishing a parting gap between said new metal layer and the underlying second segment, the ends of said new metal layers adjacent said mating ends of said underlying segments having a smooth rounded outer edge and removing said new metal layers from said underlying segments by sliding said new metal layers axially along said underlying segments, the ends of said new metal layers adjacent said mating ends of said underlying segments having a smooth rounded outer edge.

9. An electroforming process according to claim 1 wherein said segments have a square cross-sectional shape.

* * * * *